US005560508A

United States Patent [19]

Hsu

[11] Patent Number: 5,560,508

[45] Date of Patent: Oct. 1, 1996

[54] LAUNDRY CONTAINER STRUCTURE

[75] Inventor: Peyson Hsu, Changhua Hsien, Taiwan

[73] Assignee: Ching Feng Blinds Ind. Co., Ltd., Changhua Hsien, Taiwan

[21] Appl. No.: 552,783

[22] Filed: Nov. 3, 1995

[51] Int. Cl.[6] ..... B65D 27/00

[52] U.S. Cl. ..... 220/4.31; 220/4.28

[58] Field of Search ..... 220/4.28, 4.30, 220/4.31, 4.33

[56] References Cited

U.S. PATENT DOCUMENTS

| | | | |
|---|---|---|---|
| 2,549,013 | 4/1981 | Robles et al. | 220/4.31 |
| 5,236,099 | 8/1993 | Fligs et al. | 220/4.31 |

FOREIGN PATENT DOCUMENTS

| | | | |
|---|---|---|---|
| 808492 | 2/1959 | United Kingdom | 220/4.31 |

*Primary Examiner*—Joseph M. Moy
*Attorney, Agent, or Firm*—Browdy and Neimark

[57] ABSTRACT

A laundry container assembly including a base seat, an upper frame, four support columns and four wall boards. Four insertion holes are formed on four corners of the base seat and four corresponding insertion holes are formed on four corners of the upper frame. Each support column has two insertion posts respectively at an upper end and a lower end. An annular groove is formed on the insertion post. An annular projection is formed on a wall of the insertion hole, whereby the insertion post is securely inserted into the insertion hole with the annular projection engaged with the annular groove. Each wall board has two Z-shaped insertion plates on two sides. Each support column is formed with two longitudinal L-shaped insertion channels on two adjacent inner sides, whereby the four support columns are inserted into the insertion holes of the base seat and the insertion plates of the four wall boards are longitudinally downward inserted into the insertion channels of the support columns. The insertion posts of the upper ends of the support columns are further inserted into the insertion holes of the upper frame to complete the container assembly. Four hook members are disposed under four corners of the upper frame for hanging a laundry net thereon. The laundry container assembly is able to bear heavy weight. The clothes to be washed are placed in the laundry net which can be taken out and entirely thrown into a washing machine for washing.

4 Claims, 6 Drawing Sheets

FIG. 1
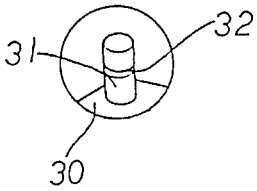
FIG. 1B
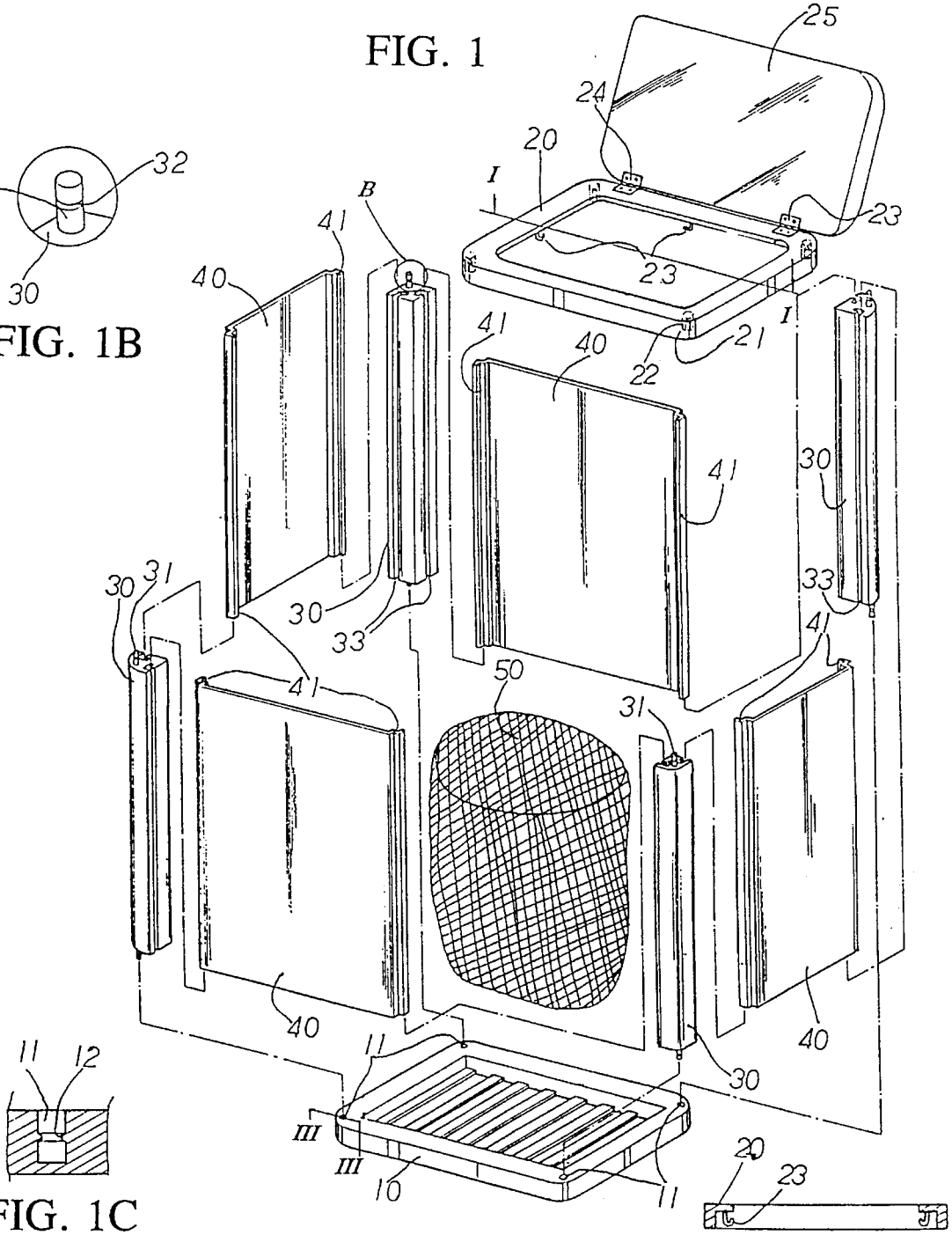
FIG. 1C
FIG. 1A

FIG. 3
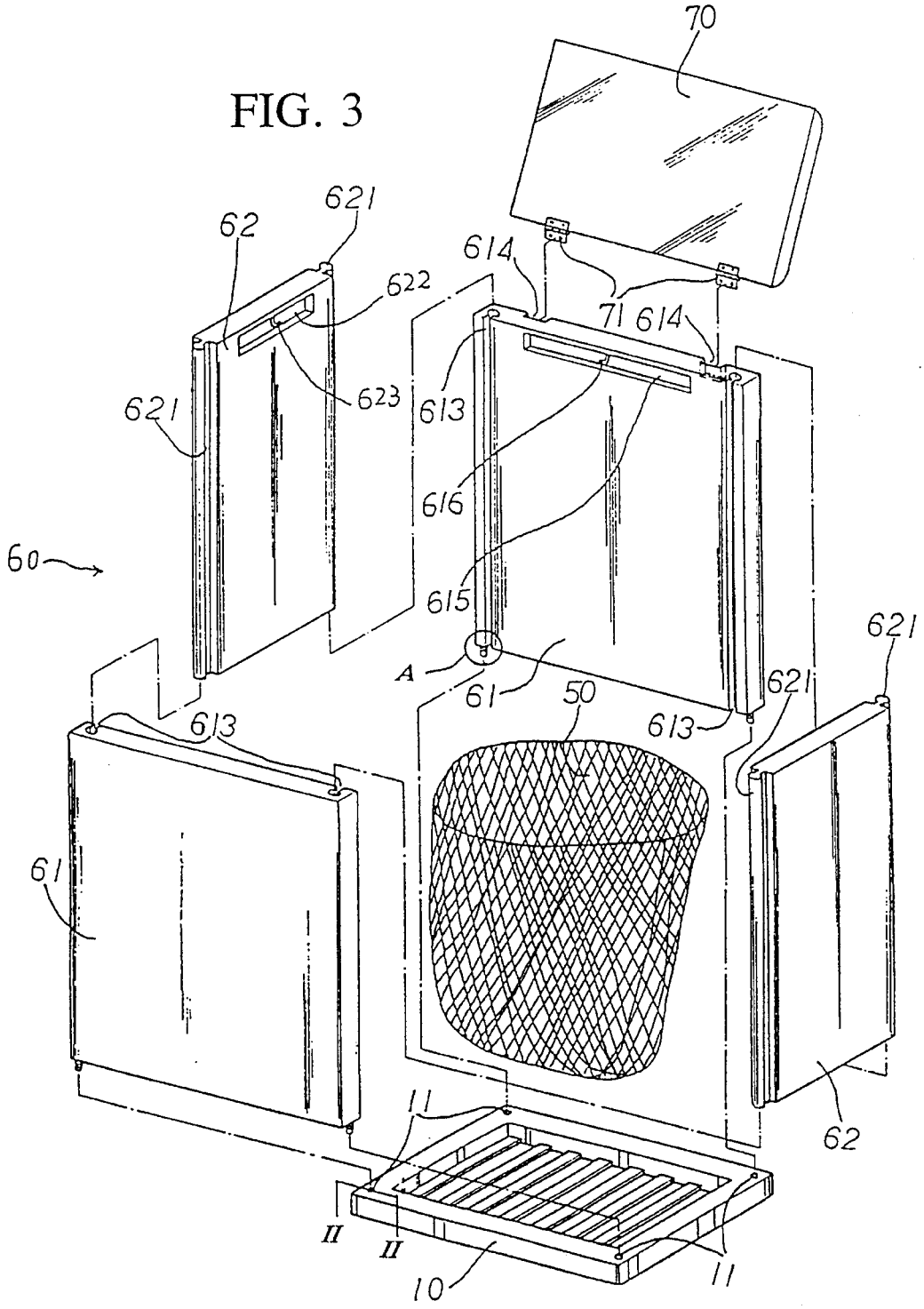
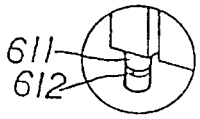
FIG. 3A
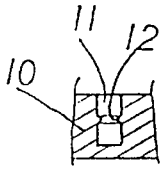
FIG. 3B

LAUNDRY CONTAINER STRUCTURE

BACKGROUND OF THE INVENTION

The present invention relates to a laundry container assembly which is firmly constructed and able to bear heavy weight. The clothes to be washed are placed in a laundry net which is hung in the container and can be taken out and entirely thrown into a washing machine for washing.

FIG. 7 shows a conventional laundry container assembly including a base seat 81, four support columns 82, an upper frame 83 and a cover 84 pivotally connected with the upper frame 83 by hinges 85. Four inclined projecting plates 811 are respectively disposed on four arch corners of the base seat 81 to together with the arch corners define four insertion spaces for the lower ends of the support columns 82 to fixedly insert therein. The lower side of the upper frame 83 is formed with similar structure for the upper ends of the support columns 82 to insert therein so as to form a laundry container assembly 80 as shown in FIG. 8. A waterproof bag 90 is fitted around the container assembly with the periphery of the upper frame 83 received in an upper opening of the bag 90. The clothes to be washed can be placed in the laundry container.

Such laundry container assembly 80 has simple structure in which the support columns 82 are only engaged with the base seat 81 and the upper frame 83 by insertion without any other reinforcing structure. Therefore, when transferring the laundry container assembly, the base seat is apt to loosen and detach from the support columns or the upper frame 83 tends to separate from the support columns. Moreover, such laundry container assembly can hardly bear heavy weight so that in case a person sits on the cover 84, the container will swing or the inclined projecting plates 811 of the base seat 81 will be biased and broken to make the support columns 82 disengaged from the base seat 81.

SUMMARY OF THE INVENTION

It is therefore a primary object of the present invention to provide a laundry container assembly which is firmly constructed and able to bear heavy weight without swinging.

It is a further object of the present invention to provide the above laundry container structure including hook members on which a laundry net is hung. The clothes to be washed are placed in the laundry net which can be directly taken out and entirely thrown into a washing machine for washing.

The present invention can be best understood through the following description and accompanying drawings, wherein:

BRIEF DESCRIPTION OF THE DRAWINGS

FIG. 1 is a perspective exploded view of the present invention;

FIG. 1A is a sectional view taken along line I—I of FIG. 1;

FIG. 1B is an enlarged view of circled area B in FIG. 1;

FIG. 1C is a sectional view taken along line III—III of FIG. 1;

FIG. 3 is a perspective exploded view of another embodiment of the present invention;

FIG. 3A is an enlarged view of circled area A in FIG. 3;

FIG. 3B is a sectional view taken along line III—III of FIG. 3;

DETAILED DESCRIPTION OF THE PREFERRED EMBODIMENTS

Figure 2:
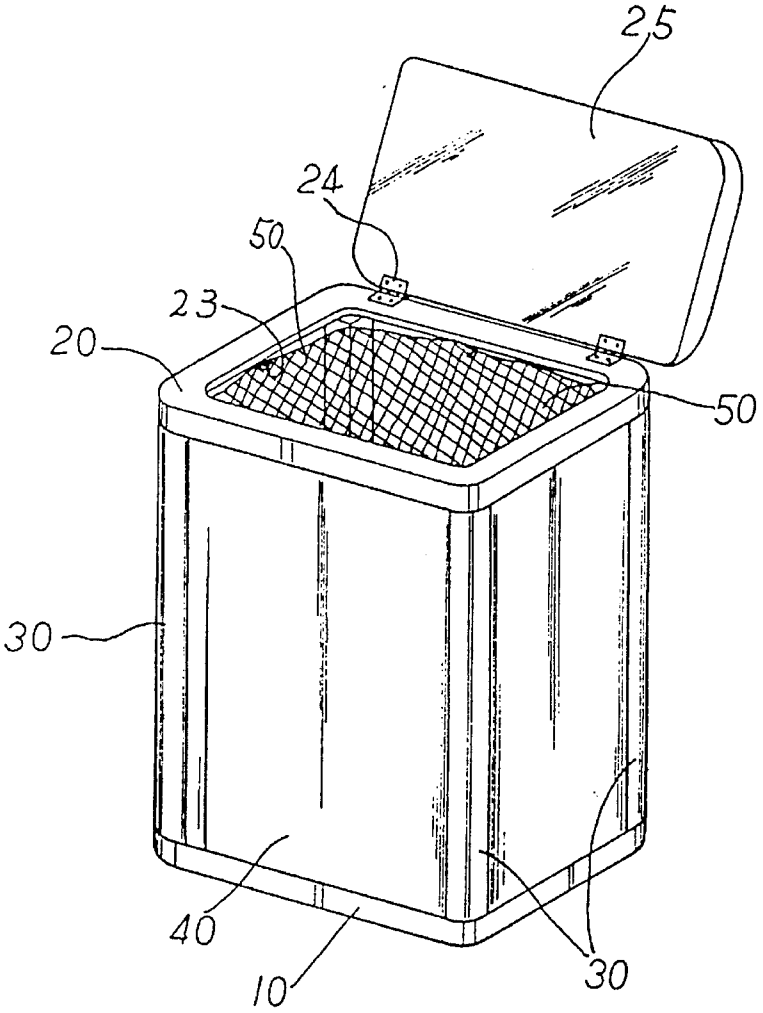
FIG. 2 is a perspective assembled view of the present invention.

Please refer to FIG. 1. The present invention includes a base seat 10, an upper frame 20, four support columns 30 and four wall boards 40. The base seat 10 is a rectangular frame body disposed with inner water and air permeable screen. Four insertion holes 11 are formed on upper surface of four corners of the base seat 10. Four corresponding insertion holes 21 are formed on lower surface of four corners of the upper frame 20. Each support column 30 has two insertion posts 31 respectively at an upper end and a lower end. An annular groove 32 is formed around the surface of the insertion post 31, while an annular projection 12 is formed on the wall of the insertion hole 11, whereby the insertion post 31 can be securely inserted into the insertion hole 11 with the annular projection 12 engaged with the annular groove 32. Each wall board 40 has two Z-shaped insertion plates 41 on two sides, while each support column 30 is formed with two longitudinal L-shaped insertion channels 33 on two adjacent inner sides, whereby the four support columns 30 are inserted into the insertion holes 11 of the base seat 10 and the insertion plates 41 of the four wall boards 40 are longitudinally downward inserted into the insertion channels 33 of the support columns 30 to define a rectangular box body. The insertion posts 31 of the upper ends of the support columns 30 are further inserted into the insertion holes 21 of the upper frame 20 to complete the container assembly. Four hook members 23 are disposed under four corners of the upper frame 20 as shown in FIG. 1A, whereby the periphery of an opening of a laundry net 50 can be hooked and hung on the hook members 23. A cover 25 is pivotally connected with one side of the upper frame 20 by hinges 24 for covering the upper opening of the container as shown in FIG. 2. According to the above arrangements, the laundry container assembly is firmly constructed and able to bear heavy weight. The clothes to be washed are placed in the laundry net 50 which can be conveniently directly taken out of the container and entirely thrown into a washing machine for washing.

Figure 4:
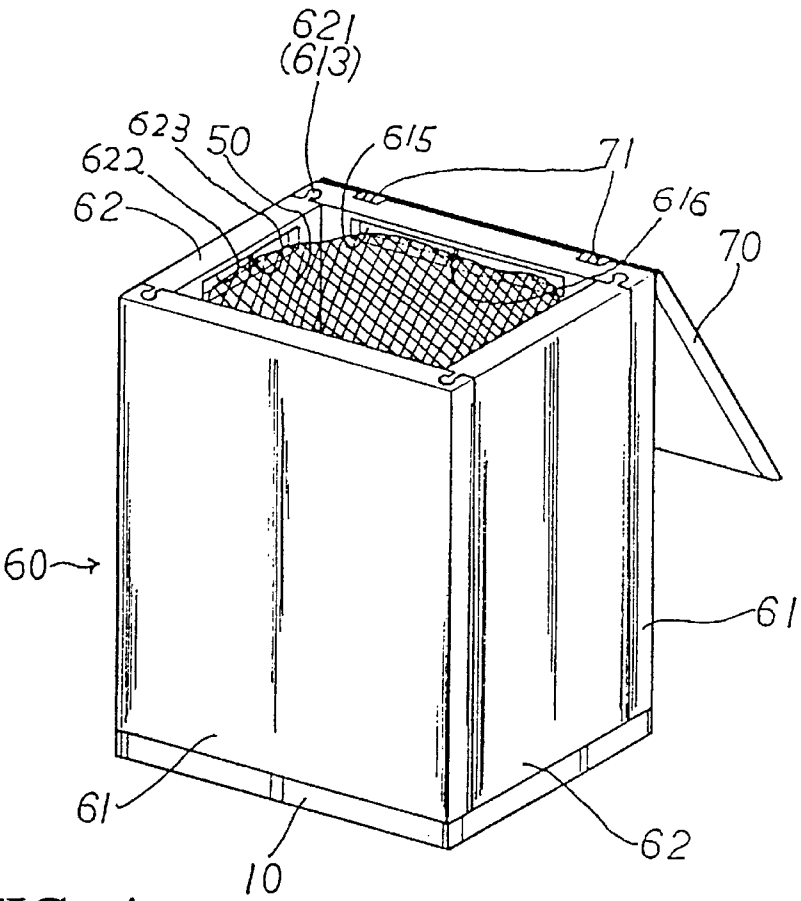
FIG. 4 is a perspective assembled view of the embodiment of FIG. 3.

FIG. 3 shows another embodiment of the present invention, including a base seat 10, two long wall boards 61, two short wall boards 62 and a cover 70. The base seat 10 is four insertion holes formed on four corners thereof. Each long wall board 61 has two insertion posts 611 respectively on two sides of a lower face thereof. An annular groove 612 is formed around the surface of the insertion post 611. An annular projection 12 is formed on the wall of the insertion hole 11, whereby the insertion post 611 can be securely inserted into the insertion hole 11 with the annular projection 12 engaged with the annular groove 612. Each long wall board 61 further has two opposite longitudinal fungus-shaped insertion channels 613 on two sides, while each short wall board 62 is formed with two longitudinal fungus-shaped insertion plates 621 on two sides corresponding to the insertion channels 613, whereby the insertion plates 621 are longitudinally inserted into the insertion channels 613 to define a rectangular box body 60. The cover 70 is pivotally connected with one side of one of the long wall boards 61 by two hinges 71 disposed in two hinge recesses 614 of the long wall board 61. Four hook members 616, 623 are disposed in four recesses 615, 622 formed along upper edges of the long and short wall boards, whereby the periphery of an opening of a laundry net 50 can be hooked and hung on the hook members 616, 623 to form a laundry container assembly as shown in FIG. 4, which is also able to bear heavy weight.

Figure 5:
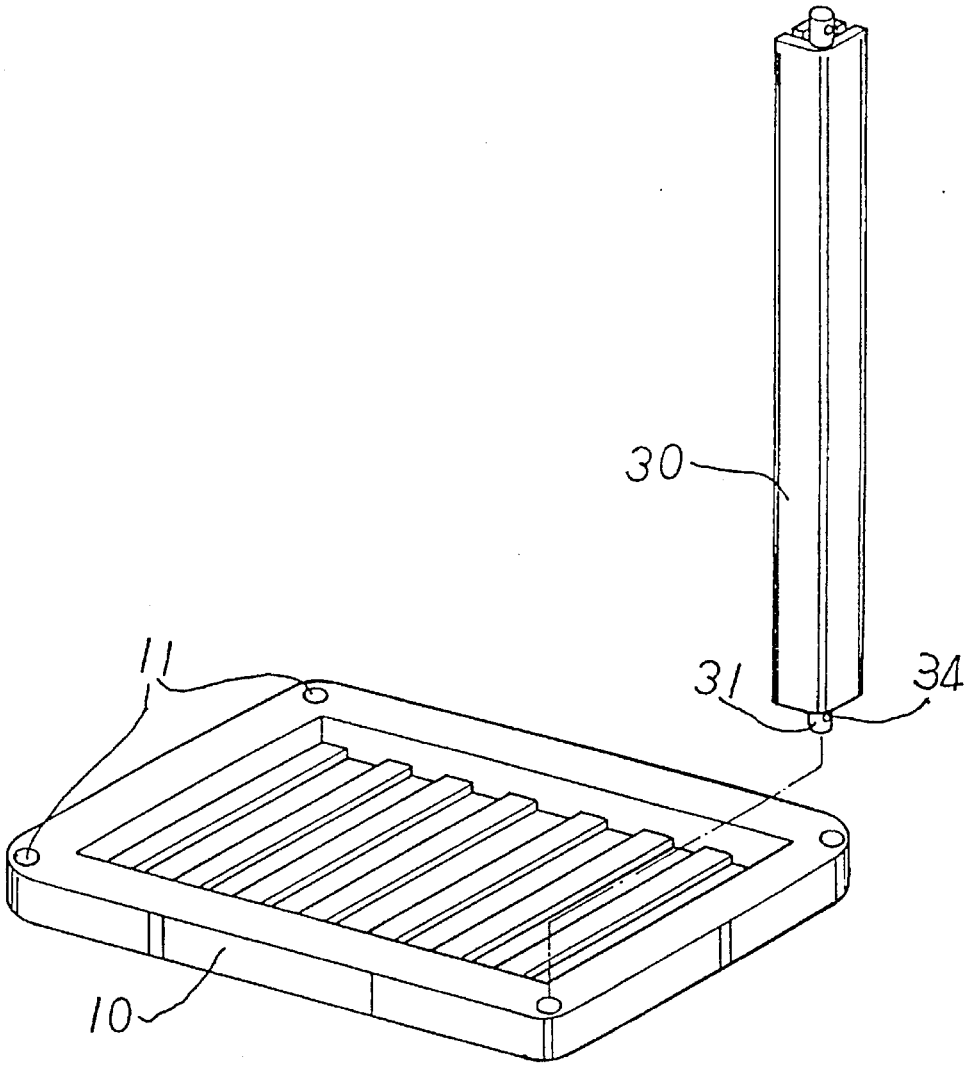
FIG. 5 is a perspective exploded view showing another aspect of the insertion post and insertion hole of the present invention.
Figure 6:
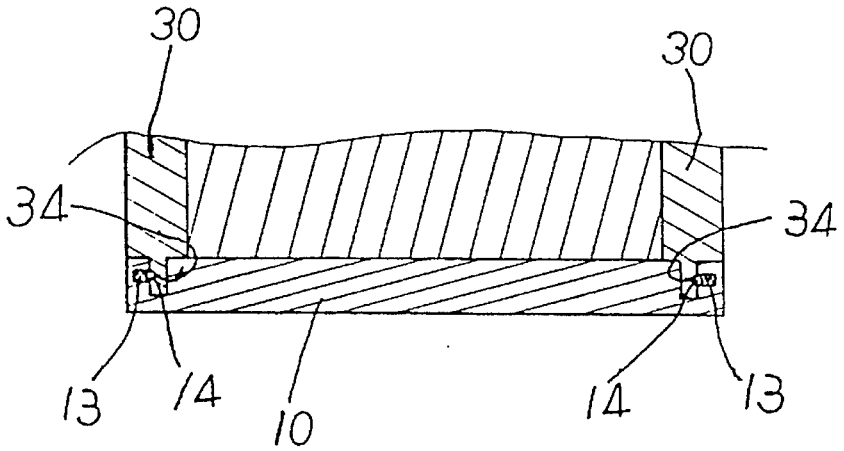
FIG. 6 is a sectional assembled view showing the aspect of the insertion post and insertion hole of FIG. 5.
Figure 7:
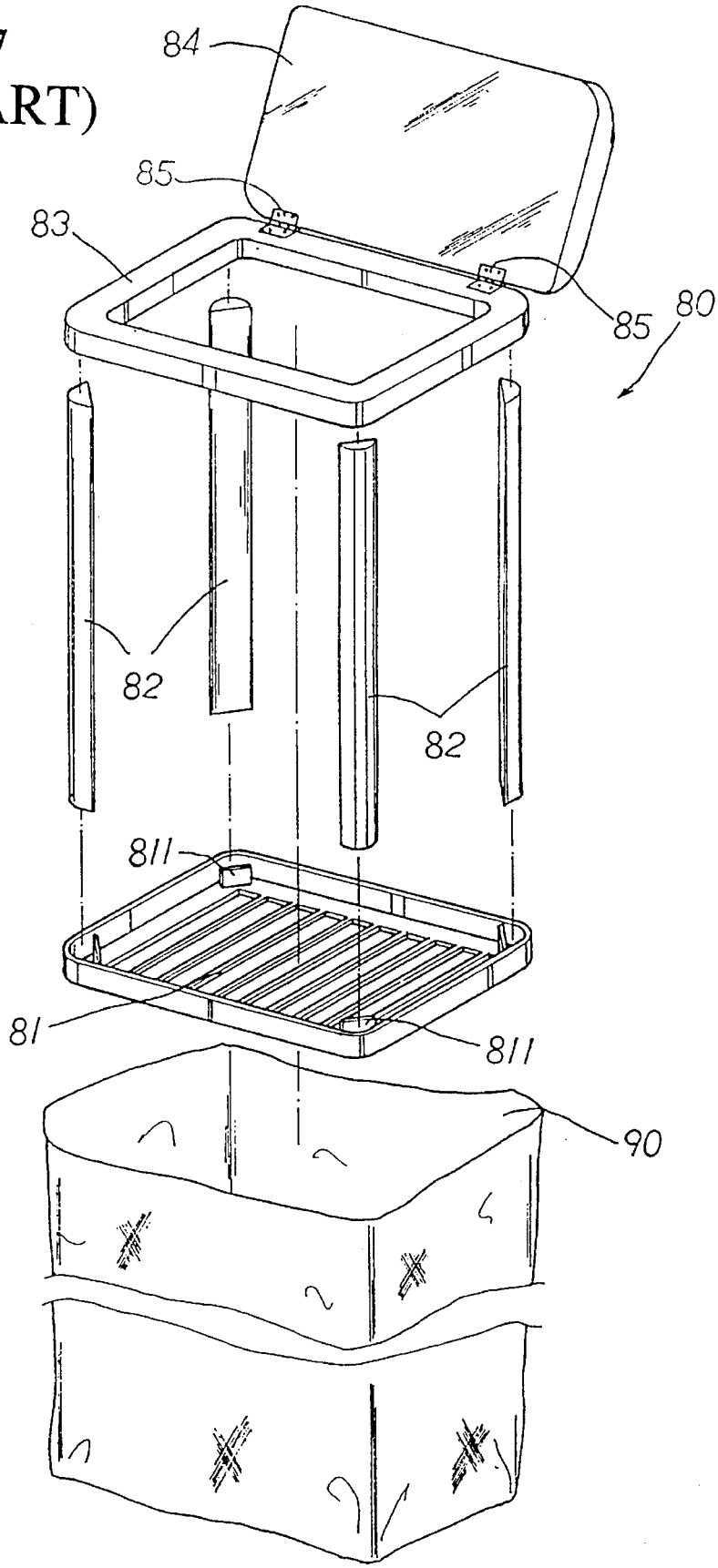
FIG. 7 (PRIOR ART)
FIG. 7 is a perspective exploded view of a conventional laundry container assembly.
Figure 8:
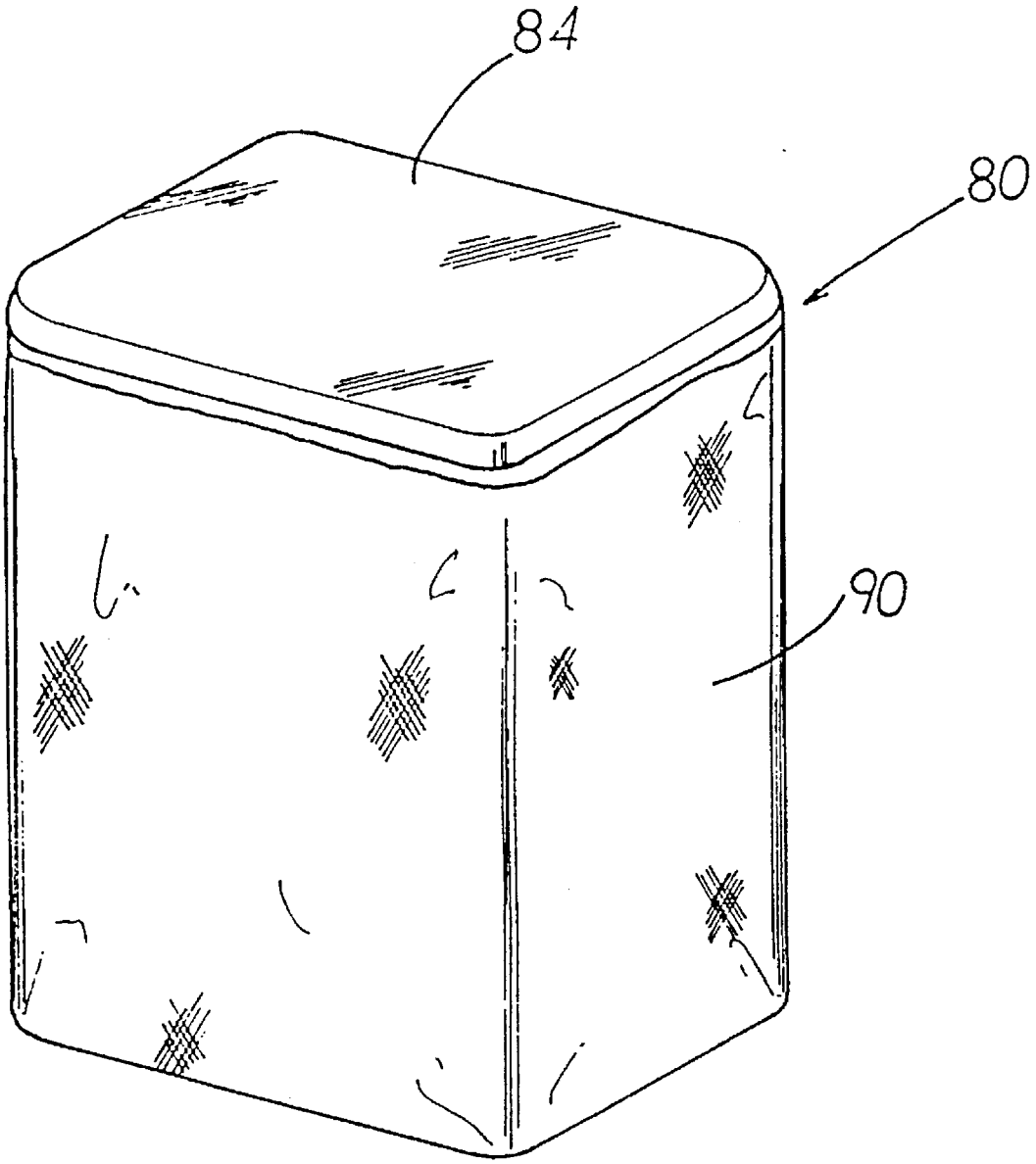
FIG. 8 (PRIOR ART)
FIG. 8 is a perspective assembled view of the conventional laundry container assembly.

FIGS. 5 and 6 show another embodiment of the insertion posts 31 of the support columns 30 and the insertion posts 611 of the long wall boards 61. An arch groove 34 is formed on the surface of the insertion post 31 and a ball member 14 resiliently urged by a spring 13 is imbedded in the wall of the insertion hole 11, 21 of the base seat 10 or the upper frame 20, whereby when the insertion post 31 is inserted into the insertion hole 11, 21, the ball member 14 is resiliently pushed into the arch groove 34 so as to engage the insertion post with the insertion hole as shown in FIG. 6.

The above embodiments are only some examples of the present invention and the scope of the present invention should not be limited to the examples. Any modification or variation derived from the examples should fall within the scope of the present invention.

What is claimed is:

1. A laundry container assembly comprising a base seat, an upper frame, four support columns and four wall boards, wherein four insertion holes being formed on upper surface of four corners of the base seat and four corresponding insertion holes are formed on lower surface of four corners of the upper frame, each support column having two insertion posts respectively at an upper end and a lower end, an annular groove being formed around a surface of the insertion post, an annular projection being formed on a wall of the insertion hole, whereby the insertion post is securely inserted into the insertion hole with the annular projection engaged with the annular groove, each wall board having two Z-shaped insertion plates on two sides, each support column being formed with two longitudinal L-shaped insertion channels on two adjacent inner sides, whereby the four support columns are inserted into the insertion holes of the base seat and the insertion plates of the four wall boards are longitudinally downward inserted into the insertion channels of the support columns to define a rectangular box body, the insertion posts of the upper ends of the support columns being further inserted into the insertion holes of the upper frame to complete the container assembly, four hook members being disposed under four corners of the upper frame, whereby a periphery of an opening of a laundry net is hooked and hung on the hook members.

2. A laundry container assembly as claimed in claim 1, comprising a base seat, two long wall boards, two short wall boards and a cover, wherein the base seat is disposed with four insertion holes formed on four corners thereof, each long wall board having two insertion posts respectively on two sides of a lower face thereof, an annular groove being formed around a surface of the insertion post, an annular projection being formed on a wall of the insertion hole, whereby the insertion post is securely inserted into the insertion hole with the annular projection engaged with the annular groove, each long wall board further having two opposite longitudinal fungus-shaped insertion channels on two sides, each short wall board being formed with two longitudinal fungus-shaped insertion plates on two sides corresponding to the insertion channels, whereby the insertion plates are longitudinally inserted into the insertion channels to define a rectangular box body, the cover being pivotally connected with one side of one of the long wall boards by two hinges disposed in two hinge recesses of the long wall board, four hook members being disposed in four recesses formed along upper edges of the long and short wall boards, whereby a periphery of an opening of a laundry net is hooked and hung on the hook members to form the laundry container assembly.

3. A laundry container assembly as claimed in claim 1, wherein an arch groove is formed on the surface of the insertion post of the support column or the long wall board and a ball member resiliently urged by a spring is imbedded in the wall of the insertion hole of the base seat or the upper frame, whereby when the insertion post is inserted into the insertion hole, the ball member is resiliently pushed into the arch groove so as to engage the insertion post with the insertion hole.

4. A laundry container assembly as claimed in claim 2, wherein an arch groove is formed on the surface of the insertion post of the support column or the long wall board and a ball member resiliently urged by a spring is imbedded in the wall of the insertion hole of the base seat or the upper frame, whereby when the insertion post is inserted into the insertion hole, the ball member is resiliently pushed into the arch groove as as to engage the insertion post with the insertion hole.

* * * * *